US011974684B2

(12) United States Patent
Warmsley

(10) Patent No.: US 11,974,684 B2
(45) Date of Patent: May 7, 2024

(54) ILLUMINATED MAILBOX DEVICE

(71) Applicant: Edward Warmsley, Fort Washington, MD (US)

(72) Inventor: Edward Warmsley, Fort Washington, MD (US)

( * ) Notice: Subject to any disclaimer, the term of this patent is extended or adjusted under 35 U.S.C. 154(b) by 0 days.

(21) Appl. No.: 17/669,746

(22) Filed: Feb. 11, 2022

(65) Prior Publication Data

US 2022/0248887 A1 Aug. 11, 2022

Related U.S. Application Data

(60) Provisional application No. 63/148,174, filed on Feb. 11, 2021.

(51) Int. Cl.
*A47G 29/12* (2006.01)

(52) U.S. Cl.
CPC ..... *A47G 29/1209* (2013.01); *A47G 2200/08* (2013.01)

(58) Field of Classification Search
CPC ..... A47G 29/1209; A47G 29/122; A47G 2200/08; A47G 2029/12105; A47G 2029/1229; G09F 23/00; G09F 13/04
USPC ..... 232/17, 38; 40/566; 362/154, 155
See application file for complete search history.

(56) References Cited

U.S. PATENT DOCUMENTS 5,143,285 A * 9/1992 Wise ..... A47G 29/1216 40/566
5,460,325 A * 10/1995 Surman ..... A47G 29/122 40/566
5,522,540 A * 6/1996 Surman ..... G02B 6/006 40/566
5,813,749 A * 9/1998 Sheldon ..... A47G 29/1209 362/183
6,102,548 A * 8/2000 Mantle ..... A47G 29/1209 362/802
6,299,325 B1 * 10/2001 Cathel ..... G09F 13/04 362/183
6,402,338 B1 * 6/2002 Mitzel ..... F21S 9/037 362/183
6,708,876 B1 * 3/2004 Shirah ..... G09F 7/10 232/38
6,719,193 B2 * 4/2004 Katulka ..... A47G 29/1209 232/38
6,799,716 B1 * 10/2004 Kuelbs ..... A47G 29/12095 232/39
6,964,366 B2 * 11/2005 Peng ..... A47G 29/1209 232/38

(Continued)

*Primary Examiner* — William L Miller

(74) *Attorney, Agent, or Firm* — Brennan, Manna & Diamond, LLC

(57) ABSTRACT

The present invention relates to an illuminated mailbox device primarily comprised of a mailbox, at least one solar panel, at least one address plate, at least one LED light, at least one motion sensor and at least one light sensor. The at least one solar panel provides power to the LED light, which may be located on the interior surface to illuminate the interior surface and the exterior of the device to illuminate the address plate which displays the address of the house at which the device is being used. The LED light is further activated by the motion sensor that is preferably activated when the front wall is in motion and/or when the light sensor that is activated by a lack of light during dawn, dusk or night.

4 Claims, 3 Drawing Sheets

(56) References Cited

U.S. PATENT DOCUMENTS

| | | | | |
|---|---|---|---|---|
| 7,293,696 | B2 * | 11/2007 | Laborde | A47G 29/122 232/38 |
| 7,350,692 | B2 * | 4/2008 | Bushee | A47G 29/1212 232/38 |
| 9,826,853 | B1 * | 11/2017 | Fonseca | A47G 29/1216 |
| 2002/0109985 | A1 * | 8/2002 | Voacolo | A47G 29/1216 362/253 |
| 2003/0053308 | A1 * | 3/2003 | Cathel | G09F 23/00 362/330 |
| 2004/0083634 | A1 * | 5/2004 | Blsson | G09F 13/04 40/566 |
| 2005/0162847 | A1 * | 7/2005 | Jahn | A47G 29/1209 362/155 |
| 2009/0196028 | A1 * | 8/2009 | Chao | G09F 13/08 362/183 |
| 2010/0073919 | A1 * | 3/2010 | Sharpe | A47G 29/1209 362/154 |
| 2015/0001283 | A1 * | 1/2015 | Morris | A47G 29/1209 232/17 |
| 2015/0108209 | A1 * | 4/2015 | Cho | G09F 27/007 232/34 |
| 2018/0103787 | A1 * | 4/2018 | Fonseca | A47G 29/1209 |

* cited by examiner

ILLUMINATED MAILBOX DEVICE

CROSS-REFERENCE TO RELATED APPLICATION

The present application claims priority to, and the benefit of, U.S. Provisional Application No. 63/148,174, which was filed on Feb. 11, 2021, and is incorporated herein by reference in its entirety.

FIELD OF THE INVENTION

The present invention relates generally to the field of mailboxes. More specifically, the present invention relates to an illuminated mailbox device primarily comprised of a mailbox body having at least one solar panel, at least one address plate, at least one LED light, at least one motion sensor, and at least one light sensor. The at least one solar panel provides power to the LED light, which may be located on the interior surface to illuminate the interior surface and the exterior of the device to illuminate the address plate, which displays the address of the house at which the device is being used. The LED light is further activated by the motion sensor that is preferably activated when the front wall is in motion and/or when the light sensor that is activated by a lack of light during dawn, dusk or night. Accordingly, the present disclosure makes specific reference thereto. Nonetheless, it is to be appreciated that aspects of the present invention are also equally applicable to other like applications, devices and methods of manufacture.

BACKGROUND

Identifying the location of a home's mailbox can be incredibly difficult during low light hours of the day and night. Without any type of lighting, a mailbox may be nearly invisible in low light conditions. As a result, a mail carrier may be unable to properly identify the homeowner's address, which can lead to mail failing to be delivered to the proper address, or failure of mail being delivered at all. Similarly, emergency first responders called to an individual's home may be unable to quickly identify the correct home address, which is extremely undesirable in emergency situations. Furthermore, individuals retrieving their mail may be unable to see inside their mailbox due to low light conditions in and around the mailbox, which may cause them to accidentally leave an important piece of mail in the back of the mailbox.

Therefore, there exists a long-felt need in the art for an improved mailbox. There also exists a long-felt need in the art for an illuminated mailbox device that adequately illuminates the interior and exterior of a mailbox. In addition, there exists a long-felt need in the art for an illuminated mailbox device that automatically illuminates the interior and exterior of the mailbox.

The subject matter disclosed and claimed herein, in one embodiment thereof, comprises an illuminated mailbox device. The device is primarily comprised of a body further comprised of at least one solar panel, at least one address plate, at least one LED light, at least one motion sensor, and at least one light sensor. The at least one solar panel provides power to the LED light, which may be located on the interior surface to illuminate the interior surface and the exterior of the device to illuminate the address plate which displays the address of the house at which the device is being used. The LED light is further activated by the motion sensor that is preferably activated when the front wall is in motion and/or when the light sensor that is activated by a lack of light during dawn, dusk, or night.

In this manner, the illuminated mailbox device of the present invention accomplishes all of the forgoing objectives and provides an improved mailbox. The device further adequately illuminates the interior and exterior of a mailbox in an automatic fashion. Therefore, the device and any mail within the device is always visible in low light conditions.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an illuminated mailbox device. The device is primarily comprised of a body further comprised of at least one solar panel, at least one address plate, at least one LED light, at least one motion sensor, and at least one light sensor. The body is further comprised of a top wall, a pair of side walls, a bottom wall further comprised of a metal or wooden post, a rear wall and a front wall with at least one pull tab that is attached to the bottom wall via at least one hinge. The body is preferably manufactured from a durable metal or a rigid plastic, wherein the body may also be any color known in the art and may be comprised of a plurality of indicia such as, but not limited to, patterns, logos, emblems, images, symbols, designs, letters, numbers, words, characters, animals, advertisements, brands, etc.

At least one side wall of the body is further comprised of at least one address plate that has a top surface that has indicia in the form of the street address and/or house number of the home the device is being used for. The plate is further bordered by and secured within a frame that is further comprised of at least one LED light which illuminates the address plate from all directions. Any portion of the interior surface of the body may also comprised of at least one LED light. All LED lights of the device may be powered by at least one solar panel and/or a battery. The solar panel is preferably located on the top wall of the body.

Any portion of the body, including the interior surface and exterior walls, may further be comprised of at least one motion sensor and at least one light sensor, wherein both sensors are in electrical communication with the LED lights. The motion sensor is preferably located on or in the front wall such that when the front wall is in motion, the LED lights on the interior surface are automatically illuminated. After motion is detected by the sensor a second time (i.e., when the device is closed) the LED lights on the interior surface will cease to illuminate. Similarly, any LED lights on the exterior of the body may illuminate when any motion sensor on the exterior of the body detects motion when a mail carrier or user approaches the device. Further, any LED lights on the exterior of the body may automatically illuminate when the light sensor located on the exterior detects the absence of light completely, or light at a level on or below a threshold value. Therefore, the light sensor automatically illuminates the LED lights when low light conditions occur around the device during dusk, dawn, night, etc.

Accordingly, the illuminated mailbox device of the present invention is particularly advantageous as provides an improved mailbox that adequately illuminates the interior and exterior of a mailbox. In addition, the illumination occurs automatically when motion or the absence of light is detected. In this manner, the illuminated mailbox device overcomes the limitations of existing mailboxes known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
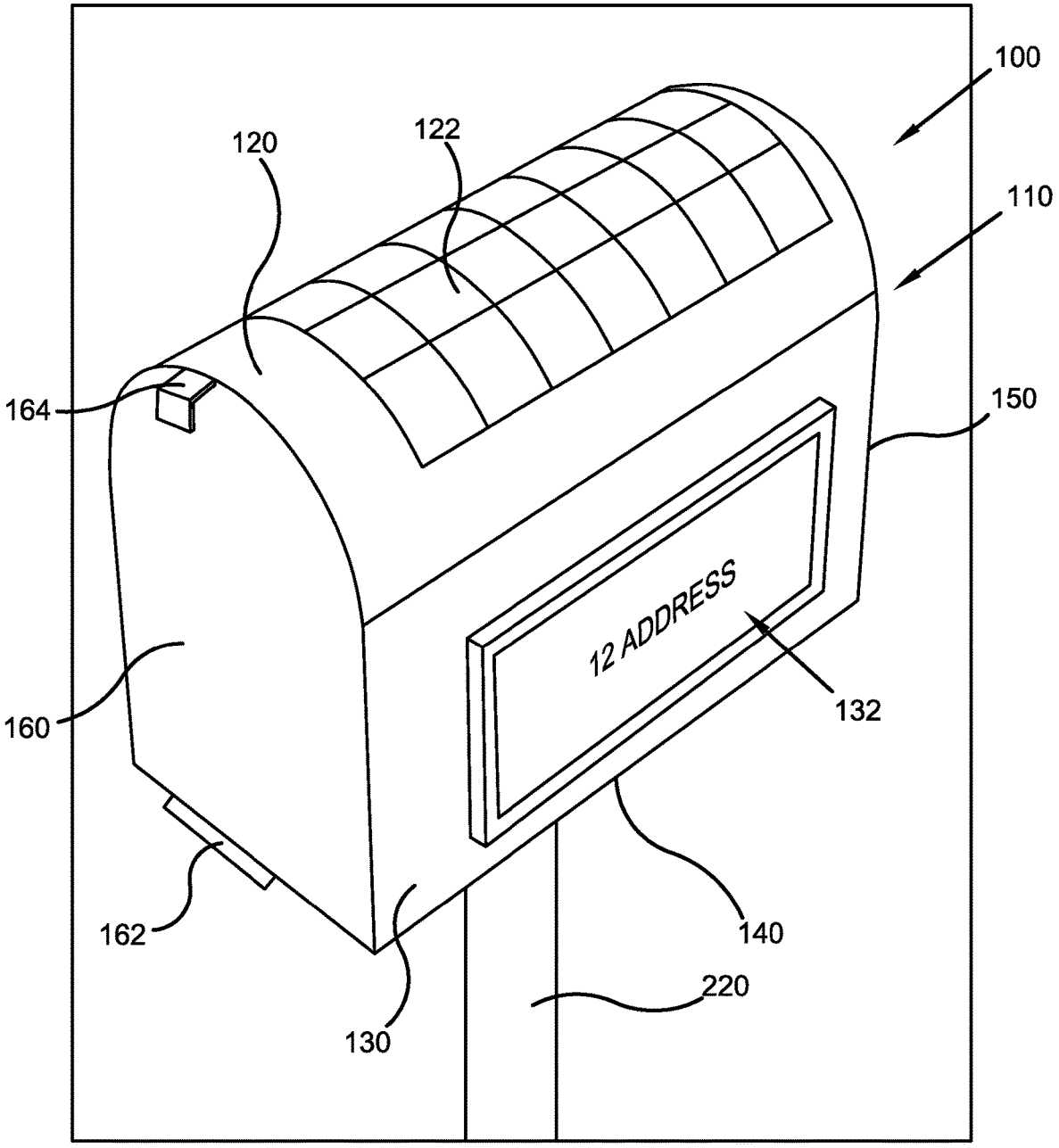
FIG. 1 illustrates a perspective view of one potential embodiment of an illuminated mailbox device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an improved mailbox. There also exists a long-felt need in the art for an illuminated mailbox device that adequately illuminates the interior and exterior of a mailbox. In addition, there exists a long-felt need in the art for an illuminated mailbox device that automatically illuminates the interior and exterior of the mailbox.

The present invention, in one exemplary embodiment, is comprised of an illuminated mailbox device primarily comprised of a body further comprised of at least one solar panel, at least one address plate, at least one LED light, at least one motion sensor and at least one light sensor. The body is further comprised of a top wall, a pair of side walls, a bottom wall further comprised of a metal or wooden post, a rear wall and a front wall with at least one pull tab that is attached to the bottom wall via at least one hinge. The body is preferably manufactured from a durable metal or a rigid plastic. The body may also be any color known in the art and may be comprised of a plurality of indicia such as, but not limited to, patterns, logos, emblems, images, symbols, designs, letters, numbers, words, characters, animals, advertisements, brands, etc.

At least one side wall of the body is further comprised of at least one address plate that has a top surface that has indicia in the form of the street address and/or house number of the home the device is being used for. The plate is further bordered by and secured within a frame that is further comprised of at least one LED light. The LED light illuminates the address plate from all directions. Any portion of the interior surface of the body may also be comprised of at least one LED light. All LED lights of the device may be powered by at least one solar panel and/or a battery. The solar panel is preferably located on the top wall of the body.

Any portion of the body, including the interior surface and exterior walls, may further be comprised of at least one motion sensor and at least one light sensor. Both sensors are in electrical communication with the LED lights. The motion sensor is preferably located on or in the front wall such that when the front wall is in motion the LED lights on the interior surface are automatically illuminated. After motion is detected by the sensor a second time (i.e., when the device is closed) the LED lights on the interior surface will cease to illuminate. Similarly, any LED lights on the exterior of the body may illuminate when any motion sensor on the exterior of the body detects motion when a mail carrier or user approaches the device. Further, any LED lights on the exterior of the body may automatically illuminate when the light sensor located on the exterior detects the absence of light completely, or light at a level on or below a threshold value. Therefore, the light sensor automatically illuminates the LED lights when low light conditions occur around the device during dusk, dawn, night, etc.

Accordingly, the illuminated mailbox device of the present invention is particularly advantageous as provides an improved mailbox that adequately illuminates the interior and exterior of a mailbox. In addition, the illumination occurs automatically when motion or the absence of light is detected. In this manner, the illuminated mailbox device overcomes the limitations of existing mailboxes known in the art.

Referring initially to the drawings, FIG. 1 illustrates a perspective view of one potential embodiment of an illuminated mailbox device 100 of the present invention in accordance with the disclosed architecture. The device 100 is primarily comprised of a body 110 further comprised of at least one solar panel 122, at least one address plate 132, at least one LED light 180, at least one motion sensor 200 and at least one light sensor 210. The body 110 has a top wall 120, a pair of side walls 130 further comprised of a rotatable mail indicator 230, a bottom wall 140 further comprised of a metal or wooden post 220, a rear wall 150 and a front wall 160 with at least one pull tab 164 that is attached to the bottom wall 140 via at least one hinge 162. The body 110 is preferably manufactured from a durable metal material such as, but not limited to, stainless steel or aluminum, or a rigid plastic such as, but not limited to, an acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, recycled plastic, biodegradable plastic, etc. The body 110 may further be any color known in the art and may be comprised of a plurality of indicia 170 such as, but not limited to, patterns, logos, emblems, images, symbols, designs, letters, numbers, words, characters, animals, advertisements, brands, etc. One such indicia 170 may give the body 110 the appearance of different building materials such as, but not limited to, brick, stone, rock, wood, etc. The body 110 is preferably generally rectangular in shape, but may be any shape known in the art in differing embodiments based on the design preferences of the user. This includes traditional and non-traditional mailbox shapes. In one embodiment, the top wall 120 may be curved and convex in shape.

Figure 2:
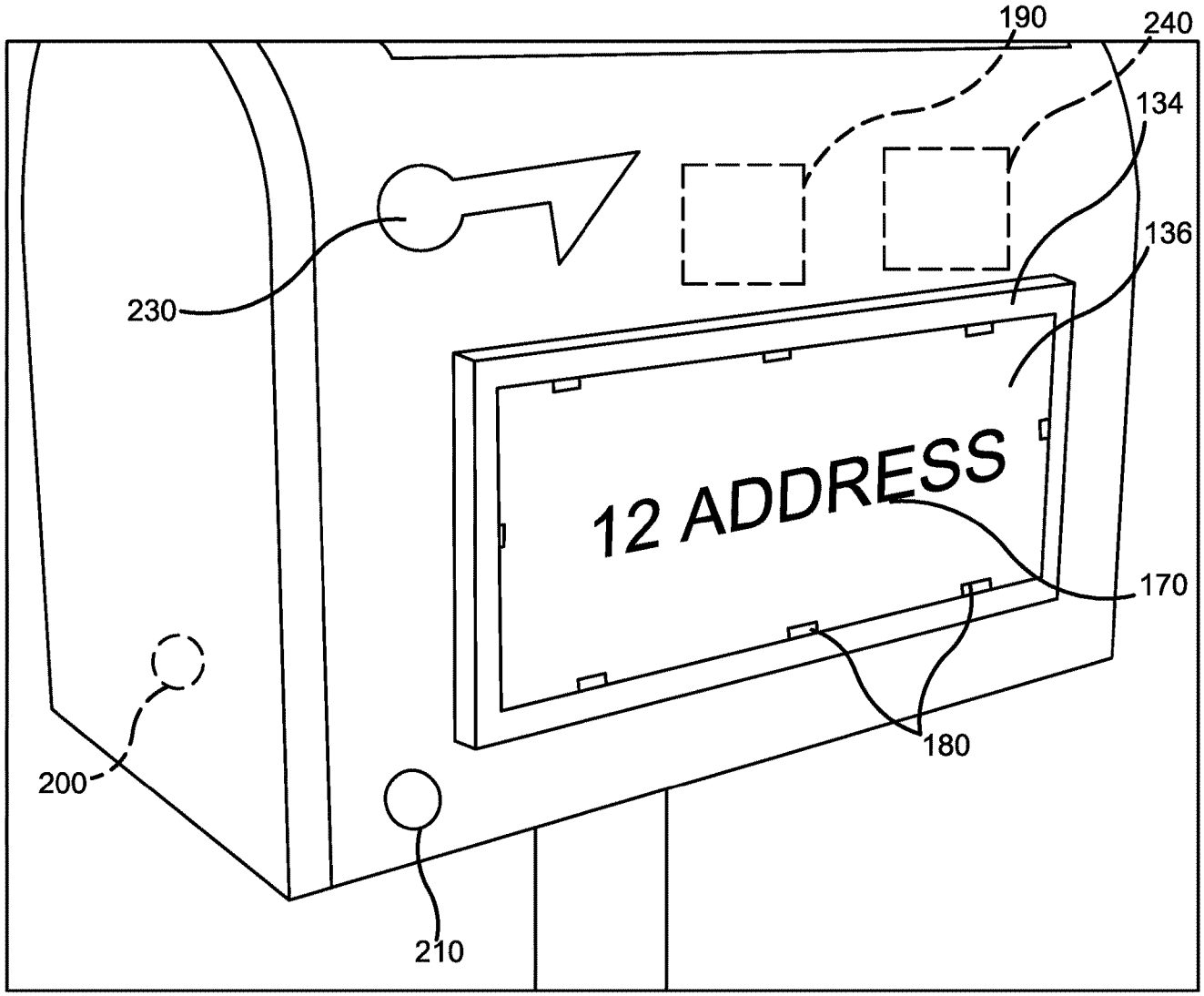
FIG. 2 illustrates a perspective view of one potential embodiment of an illuminated mailbox device of the present invention in accordance with the disclosed architecture.

FIG. 2 illustrates a perspective view of one potential embodiment of an illuminated mailbox device 100 of the present invention in accordance with the disclosed architecture. At least one side wall 130 of the body 110 is further comprised of at least one address plate 132. The plate 132 has a top surface 136 that has indicia 170 in the form of the street address and/or house number of the home the device 100 is being used for. The plate 132 is further bordered by and secured within a frame 134, wherein the frame 134 is fixedly attached to the side wall 130. However, in one embodiment the address plate 132 may be removable from the frame 134 in order to allow the plate 132 to be changed or replaced as needed. The frame 134 and plate 132 are further preferably waterproof and weather resistant. The frame 134 is further comprised of at least one LED light 180 that illuminates the address plate 132 from all directions (i.e., radially around the frame 134). The LED light 180 may be of any color known in the art. Any portion of the interior surface 112 of the body 110 may also be comprised of at least one LED light 180.

All LED lights 180 of the device 100 may be powered by at least one solar panel 122 and/or a battery 190, wherein the solar panel 122, battery 190, and LED 180 are in electrical communication via a processor 240. The solar panel 122 is preferably located on the top wall 120 and may be comprised of, but not limited to, a monocrystalline silicon, polycrystalline silicon or a photovoltaic cell film. In one embodiment, the panel 122 directly supplies power to the LED lights 180. However, in a differing embodiment, the panel 122 supplies power to a battery 190, which then supplies power to the LED lights 180. The battery 190 may be a disposable battery 190 or a rechargeable battery 190 in the form of an alkaline, nickel-cadmium, nickel-metal hydride battery 190, etc. such as any 3V-12 volts DC battery 190 or other conventional battery 190 such as A, AA, AAA, etc., that supplies power to the device 100. Throughout this specification the terms "battery" and "batteries" may be used interchangeably to refer to one or more wet or dry cells or batteries 190 of cells in which chemical energy is converted into electricity and used as a source of DC power. References to recharging or replacing batteries 190 may refer to recharging or replacing individual cells, individual batteries 190 of cells, or a package of multiple battery cells as is appropriate for any given battery 190 technology that may be used.

Figure 3:
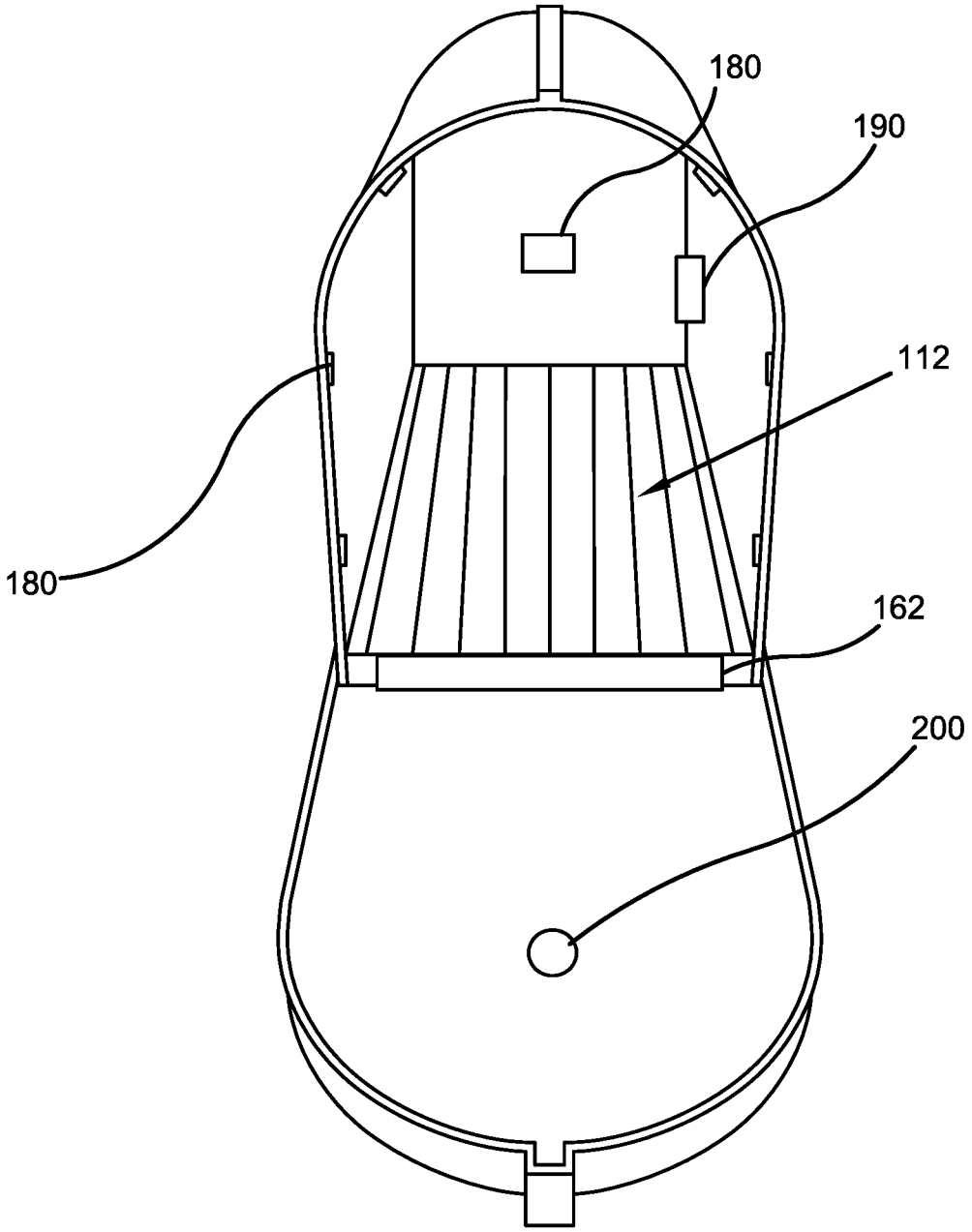
FIG. 3 illustrates a perspective view of one potential embodiment of an illuminated mailbox device of the present invention in accordance with the disclosed architecture.

Any portion of the body 110, including the interior surface 112 (as seen in FIG. 3) and exterior walls 120,130,140,160, may further be comprised of at least one motion sensor 200 and at least one light sensor 210. Both sensors 200,210 are in electrical communication with the LED lights 180 via the processor 240. The motion sensor 200 is preferably located on or in the front wall 160, such that when the front wall 160 is in motion and the sensor 200 is activated (i.e., when a user opens the device 100 to retrieve mail) the LED lights 180 on the interior surface 112 are automatically illuminated. Then, after motion is detected by the sensor 200 a second time (i.e., when the device 100 is closed) the LED lights 180 on the interior surface 112 will cease to illuminate. Similarly, any LED lights 180 on the exterior of the body 110 may illuminate when any motion sensor 200 on the exterior of the body 110 detects motion when a mail carrier or user approaches the device 100. Further, any LED lights 180 on the exterior of the body 110 may automatically illuminate when the light sensor 210 located on the exterior detects the absence of light completely, or light at a level on or below a threshold value. In this manner, the light sensor 210 automatically illuminates the LED lights 180 when low light conditions occur around the device 100 during dusk, dawn, night, etc.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "illuminated mailbox device" and "device" are interchangeable and refer to the illuminated mailbox device 100 of the present invention.

Notwithstanding the forgoing, the illuminated mailbox device 100 of the present invention and its various components can be of any suitable size and configuration as is known in the art without affecting the overall concept of the invention, provided that they accomplish the above-stated objectives. One of ordinary skill in the art will appreciate that the size, configuration and material of the illuminated mailbox device 100 as shown in the FIGS. are for illustrative purposes only, and that many other sizes and shapes of the illuminated mailbox device 100 are well within the scope of the present disclosure. Although the dimensions of the illuminated mailbox device 100 are important design parameters for user convenience, the illuminated mailbox device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An illuminated mailbox device comprising:

an interior surface;

a top wall further comprised of a solar panel;

a side wall;

a bottom wall;

a front wall further comprised of a pull tab and a hinge that attaches the front wall to the bottom wall;

an interior LED light positioned on the interior surface;

a post;

a processor;

a mail indicator;

a motion sensor located within the front wall;

a light sensor; and an address plate further comprised of an indicia, wherein the address plate is enclosed by a frame surrounded by an exterior LED element; and wherein the frame is removably attachable to the sidewall; and wherein the interior LED light is activated when the motion sensor detects an initial motion and deactivated when the motion sensor detects a subsequent motion.

2. The illuminated mailbox device of claim 1, wherein the light sensor is located on the side wall.

3. The illuminated mailbox device of claim 2, wherein the exterior LED element is illuminated when the light sensor detects an absence of light.

4. The illuminated mailbox device of claim 3, wherein the indicia is a mailing address.

* * * * *